US011445748B2

(12) United States Patent
Hilala

(10) Patent No.: US 11,445,748 B2
(45) Date of Patent: Sep. 20, 2022

(54) HOOKAH BOWL

(71) Applicant: Raid Hilala, Anaheim, CA (US)

(72) Inventor: Raid Hilala, Anaheim, CA (US)

( * ) Notice: Subject to any disclaimer, the term of this patent is extended or adjusted under 35 U.S.C. 154(b) by 255 days.

(21) Appl. No.: 16/750,614

(22) Filed: Jan. 23, 2020

(65) Prior Publication Data

US 2020/0236991 A1 Jul. 30, 2020

Related U.S. Application Data

(60) Provisional application No. 62/796,158, filed on Jan. 24, 2019.

(51) Int. Cl.
*A24F 1/30* (2006.01)

(52) U.S. Cl.
CPC ..... *A24F 1/30* (2013.01)

(58) Field of Classification Search
None
See application file for complete search history.

(56) References Cited

U.S. PATENT DOCUMENTS

| | | | |
|---|---|---|---|
| 8,459,269 | B2 | 6/2013 | Zoumut |
| 8,464,725 | B2 | 6/2013 | Badawi |
| 2016/0037825 | A1 | 2/2016 | Stein |
| 2016/0143353 | A1 | 5/2016 | Bavar |
| 2017/0055570 | A1 | 3/2017 | Elhalwani |
| 2017/0265521 | A1 | 9/2017 | Do |

*Primary Examiner* — Dennis R Cordray
(74) *Attorney, Agent, or Firm* — Boudwin Intellectual Property; Daniel Boudwin

(57) ABSTRACT

A hookah bowl. The hookah bowl includes a bowl with a lower stem disposed on a bottom surface of the bowl. The lower stem secures the bowl to an upper end of a reservoir of a hookah pipe. The bowl also has a central receiver disposed upwardly from a center portion of the bowl which is in fluid communication with the reservoir. The central receiver receives a smoking material, such as tobacco. The bowl further includes a ring around a circumference of the central receiver which receives a heating material, such as charcoal. The bowl has a collar disposed upwardly from an outer perimeter of the bowl which can reflect heat towards the central receiver. The hookah bowl can be used to efficiently heat a smoking material while containing consumed materials.

15 Claims, 2 Drawing Sheets

HOOKAH BOWL

CROSS REFERENCE TO RELATED APPLICATIONS

This application claims the benefit of U.S. Provisional Application No. 62/796,158 filed on Jan. 24, 2019. The above identified patent application is herein incorporated by reference in its entirety to provide continuity of disclosure.

BACKGROUND OF THE INVENTION

The present invention relates to hookahs. More particularly, the present invention provides for a hookah bowl which can be used to contain a smoking material in a separate compartment as a heating material while keeping the smoking material in fluid communication with a reservoir of a hookah. The present hookah bowl includes a collar disposed upwardly from an outer perimeter of the bowl which can reflect heat towards the smoking material.

Many people enjoy smoking various substances, such as tobacco, via a hookah. Standard hookahs heat the substances by positioning a hot material, such as charcoal, near the tobacco to cause it to burn. Typically, the tobacco is placed in a bowl and covered with a perforated material. The charcoal is placed on top of the perforated material and burns the tobacco by transfer of heat. The resulting smoke is pulled through a reservoir containing water and bubbles to the surface. A user is then able to pull the smoke into their mouth via a hose and a one-way valve in order to inhale the smoke. However, in such an arrangement, only a portion of the tobacco is exposed to the heat. Thus, the tobacco is heated unevenly, and some portions may not be heated at all. In standard hookahs, the charcoal falls away into a pan after it is burnt. This can be quite messy and potentially dangerous. Charcoal can be hot, and the ashes can be difficult to keep in one place. Ashes blown away may start a fire if not contained. Relatedly, hookahs may be too dangerous to be used outdoors if winds are too strong.

Devices have been disclosed in the known art that relate to hookahs. These include devices that have been patented and disclosed in patent application publications. However, the devices in the known art have several drawbacks. Some hookah bowls rest on top of the hookah and simply gather the tobacco in a pile, resulting in uneven and inefficient burning. Other hookah bowls include perforations in order to allow for greater heat transfer, but do not serve to contain the ashes of the consumed charcoal. These hookah bowls also do not maximize the transfer of heat and rely on close proximity of the tobacco to the charcoal.

The present invention substantially diverges in design elements from the known art and consequently it is clear that there is a need in the art for an improvement to existing hookah devices. In this regard the present invention substantially fulfills these needs.

SUMMARY OF THE INVENTION

In view of the foregoing disadvantages inherent in the known types of hookah bowls now present in the prior art, the present invention provides a hookah bowl wherein the same can be utilized to efficiently heat a smoking material as well as contain consumed materials. The present hookah bowl comprises a bowl with a lower stem disposed on a bottom surface of the bowl. The lower stem secures the bowl to an upper end of a reservoir of a hookah pipe. The bowl also has a central receiver disposed upwardly from a center portion of the bowl which is in fluid communication with the reservoir. The central receiver receives a smoking material, such as tobacco. The bowl further includes a ring around a circumference of the central receiver which receives a heating material, such as charcoal. The bowl has a collar disposed upwardly from an outer perimeter of the bowl which can reflect heat towards the central receiver.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
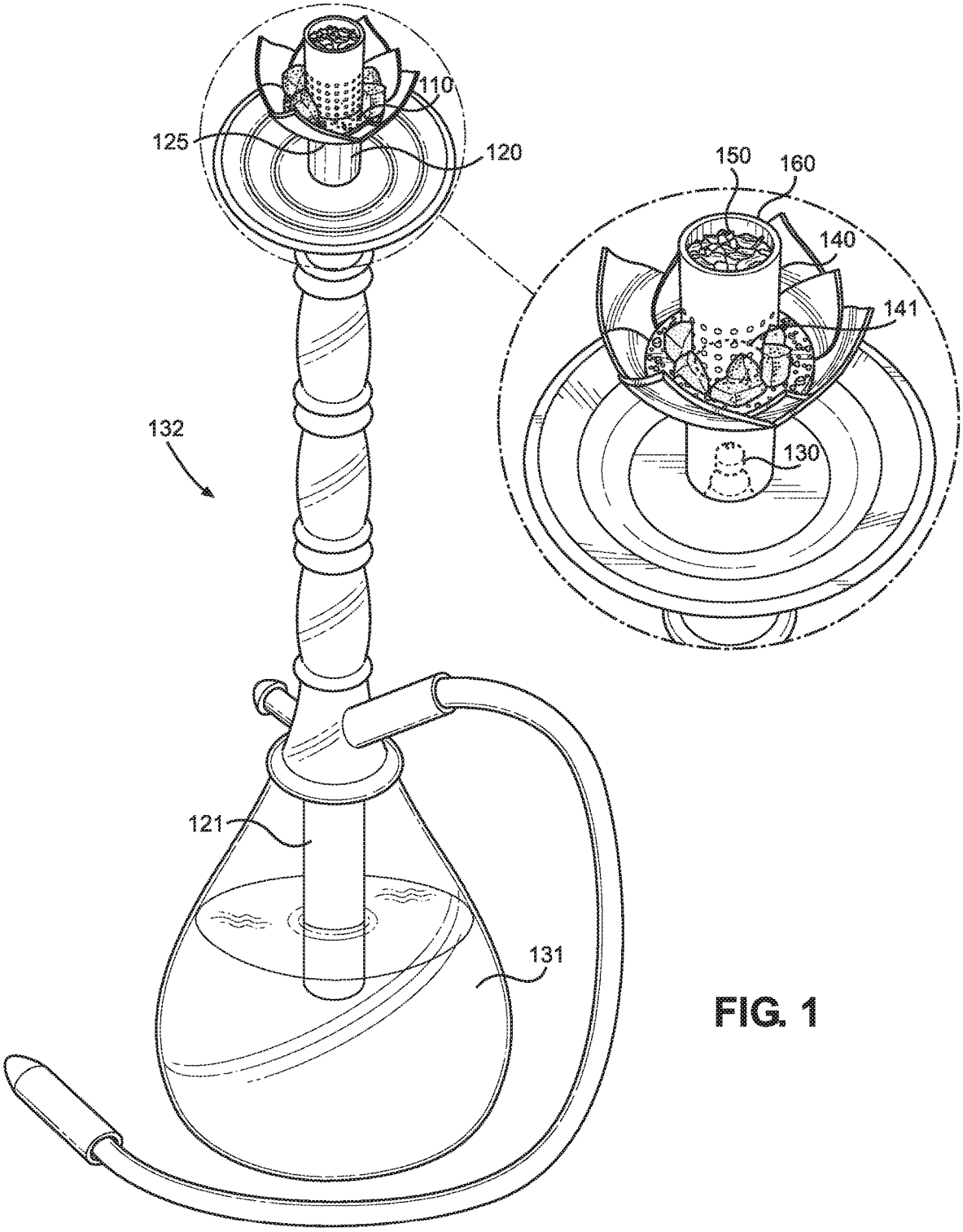
FIG. 1 shows a perspective view of an embodiment of the hookah bowl in use.

Reference is made herein to the attached drawings. Like reference numerals are used throughout the drawings to depict like or similar elements of the hookah bowl. For the purposes of presenting a brief and clear description of the present invention, a preferred embodiment will be discussed as used for the hookah bowl. The figures are intended for representative purposes only and should not be considered to be limiting in any respect.

Referring now to FIG. 1, there is shown a perspective view of an embodiment of the hookah bowl in use. The hookah bowl comprises bowl 110 with a lower stem 120 disposed on a bottom surface 125 of the bowl 110. The lower stem 120 is configured to secure the bowl 110 to an upper end 130 of a reservoir 131 of a hookah pipe 132. In one embodiment, the lower stem 120 is cylindrical and mates with a cylindrical hollow column 121 disposed along the length of the hookah pipe 132 into the reservoir 131. In the shown embodiment, the inside diameter of the lower stem 120 is the same as the outside diameter of the hollow column 121. In one embodiment, the lower stem 120 is configured to friction fit over the hollow column 121. In another embodiment, the lower stem 120 is secured in place by a fastener. The lower stem 120 is securely fastened to the hollow column 121 such that smoke generated by burning a smoking material 150 can be pulled by suction through the hollow column 121 and into the reservoir 131 with little to no loss of the smoke to the outside environment.

The bowl 110 further comprises a central receiver 140 disposed upwardly from a center portion 141 of the bowl 110. In one embodiment, the central receiver 140 is a hollow cylindrical column wherein the inside diameter of the central receiver 140 is the same as the inside diameter of the hollow column 121. In this embodiment, the central receiver 140 acts as an extension of the hollow column 121 in order to provide a seamless transition. In the shown embodiment, the inside diameter of the central receiver 140 is the same as the outside diameter of the hollow column 121. In this embodiment, the inside diameter of the central receiver 140 friction fits against the outside surface of the hollow column 121 providing a tight seal so as to reduce the loss of smoke to the outside environment.

The central receiver 140 is adapted to receive a smoking material 150 such as tobacco. In the shown embodiment, the central receiver 140 has an open upper end 160 which provides an easy manner in which a user can add, remove, or move around the smoking material 150 in the central receiver 140. The central receiver 140 is configured to isolate the smoking material 150 and position the smoking material 150 close to a heat source located around the perimeter of the central receiver 140 without direct contact thereto. In the shown embodiment, the smoking material 150 is packed within the central receiver 140 and the heat source is placed exterior to, and adjacent to the central receiver 140. The central receiver 140 includes a plurality of apertures which enable heat to flow from the heat source, through the central receiver 140 and to the smoking material 150. The central receiver 140 is in fluid communication with the reservoir 131. In the shown embodiment, the central receiver 140 and the hollow column 121 are both hollow and cylindrical, and an open end of the central receiver 140 is positioned on top of an open end of the hollow column 121, thereby providing a continuous pathway between the central receiver 140 and the reservoir 131.

The central receiver 140 is also configured to position the smoking material 150 in fluid communication with the reservoir 131 by strategically positioning the smoking material 150 in fluid communication with the hollow column 121. In this manner a user is able to pack a bowl 110 with smoking material 150 and leave the smoking material 150 in thermal communication with the heat source. The central receiver 140 protects the smoking material 150 from strong air flows such as wind, and contains the smoking material 150 in one area in order to allow the user to smoke the smoking material 150 in a variety of environments, such as outside, without the smoking material 150 falling or being blown out of position. In the shown embodiment, each petal can be independently positioned in order to adjust the flow of heat from the heat source into the central receiver 140 as well as protect the heat source from outside forces such as wind. In a further embodiment, each petal is flexible and can hold a desired position and orientation.

Figure 2:
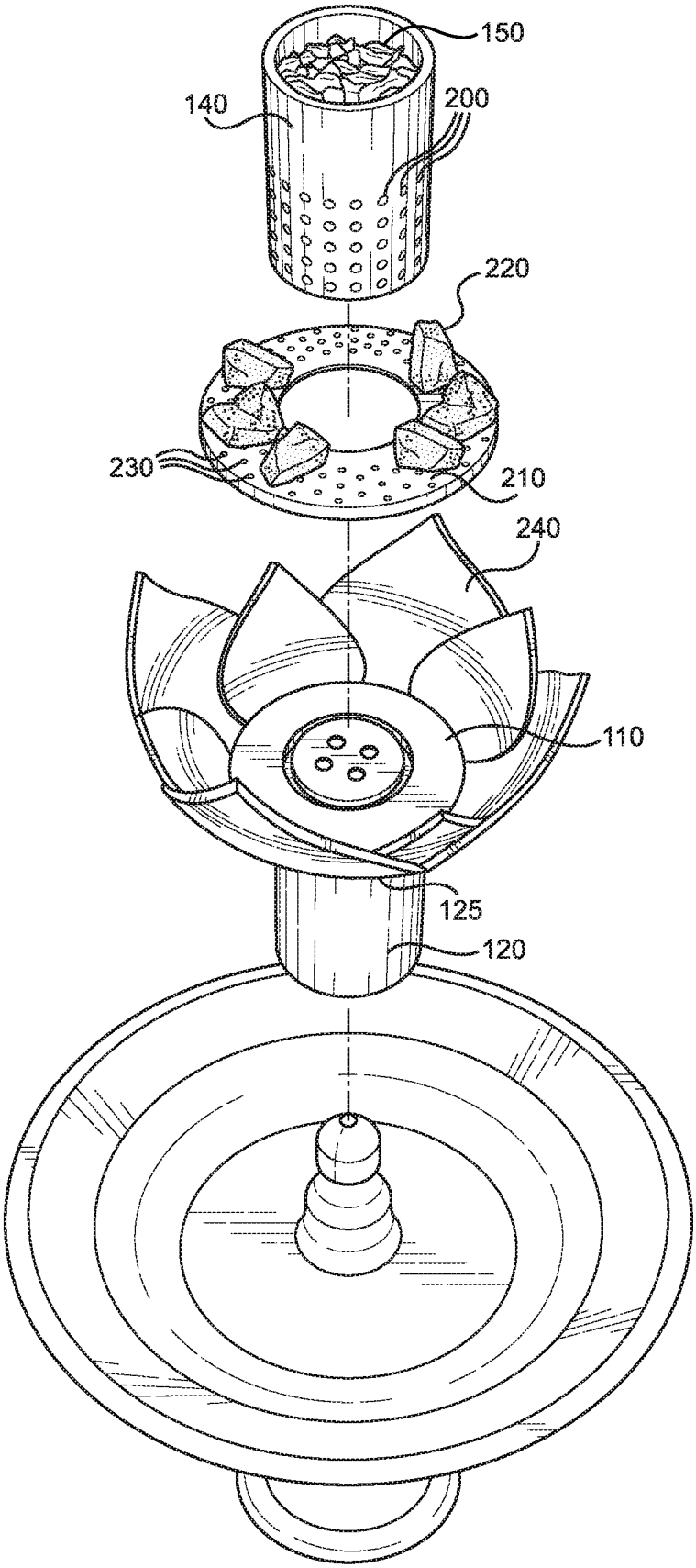
FIG. 2 shows an exploded view of an embodiment of the hookah bowl.

Referring now to FIG. 2, there is shown an exploded view of an embodiment of the hookah bowl. In the shown embodiment, the central receiver 140 comprises a plurality of receiver apertures 200 disposed therethrough. The receiver apertures 200 provide for increased airflow to the interior of the central receiver 140. The increased airflow aids in efficiently burning the smoking material 150 in an even manner. In this way, fewer sections of the smoking material 150 are insulated from the heat source, and more of the smoking material 150 is able to be burned. In the shown embodiment, the receiver apertures 200 are sized to allow ash from the smoking material 150 to pass through the receiver apertures 200 thereby preventing buildup of ash along the inner circumference of the central receiver 140. The receiver apertures 200 are also sized such that the smoking material 150 is not able to pass therethrough, thereby ensuring that the smoking material 150 is contained within the central receiver 140. In the shown embodiment, the receiver apertures 200 are disposed through a bottom two-thirds of the central receiver 140 in order to provide increased airflow to the smoking material 150 as well as providing a solid upper one-third portion to aid in containing the smoking material 150 within the central receiver 140. In such an embodiment, the solid upper one-third portion prevents wind or other external forces from dislodging or shifting the smoking material 150 as the upper one-third portion is more likely to be impacted.

In the shown embodiment, the central receiver 140 is removably securable to the bowl 110. In use, a user is able to remove the central receiver 140 in order to add or remove smoking material 150 more conveniently before or after a smoking session. Additionally, by removing the central receiver 140, a user is able to thoroughly clean out the surfaces of the central receiver 140, thereby providing clean surfaces for the next smoking session that are not tainted by residue from previous sessions. Such a cleaning also enables a user to ensure that the receiver apertures 200 are unobstructed thereby providing the desired airflow to the smoking material.

The bowl 110 further comprises a ring 210 disposed around a circumference of the central receiver 140. The ring 210 is adapted to receive a heating material 220, such as charcoal. In one embodiment, the ring 210 is comprised of a heat reflective material such that heat emanating from the lower portion of the heating material 220 is reflected back up and towards the smoking material 150. In the shown embodiment, the ring 210 further comprises a plurality of ring apertures 230 disposed therethrough. Similar to the receiver apertures 200, the ring apertures 230 enable the flow of air through the ring 210 and into the heating material 220. The ring apertures 230 are sized to allow ash generated by the heating material 220 to pass through the ring 210 and be collected by the bowl 110. In this manner, ash generated by the heating material 220 is contained by the bowl 110 and does not interfere with the heating material 220 providing heat to the smoking material 150.

The bowl 110 further comprises a collar 240 disposed upwardly from an outer perimeter of the bowl 110. The collar 240 provides the benefit of containing the heating material 220 in order to prevent it from spilling out or blowing away. The collar 240 contains dangerous embers that may emanate from hot and burning heating material 220. In one embodiment, the collar 240 is comprised of a heat reflective material. In a further embodiment, the heat reflective material is porcelain. The heat reflective material reflects heat emanating from the heating material 220 back towards the central receiver 140 in order to maximize the heat for use on the smoking material 150. In one embodiment, the collar 240 is flexible in order to provide a user with the ability to customize and fine-tune the amount of heat that is redirected and the direction in which the heat is reflected. In one embodiment, the collar 240 tapers outwardly from an outer perimeter of the bowl 110 in order to provide a larger space into which a heating material 220 may be placed. In the shown embodiment, the collar 240 is continuous with the bowl 110 in order to provide a seamless transition.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hookah bowl, comprising:

a bowl including a lower stem disposed on a bottom surface of the bowl;

the lower stem secures the bowl to an upper end of a reservoir of a hookah pipe;

the bowl further comprising a central receiver disposed upwardly from a center portion of the bowl;

the central receiver in fluid communication with the reservoir;

the central receiver adapted to receive a smoking material;

the bowl further comprising a ring disposed around a circumference of the central receiver;

the ring adapted to receive a heating material;

the bowl further comprising a collar disposed upwardly from an outer perimeter of the bowl;

wherein the collar is comprised of a heat reflective material.

2. The hookah bowl of claim 1, wherein the heat reflective material is porcelain.

3. The hookah bowl of claim 1, wherein the collar is flexible.

4. The hookah bowl of claim 1, wherein the lower stem is cylindrical.

5. The hookah bowl of claim 1, wherein the central receiver is cylindrical.

6. The hookah bowl of claim 1, wherein the central receiver has an open upper end.

7. A hookah bowl, comprising:

a bowl including a lower stem disposed on a bottom surface of the bowl;

the lower stem secures the bowl to an upper end of a reservoir of a hookah pipe;

the bowl further comprising a central receiver disposed upwardly from a center portion of the bowl;

the central receiver in fluid communication with the reservoir;

the central receiver adapted to receive a smoking material;

the central receiver further comprising a plurality of receiver apertures disposed therethrough;

the bowl further comprising a ring disposed around a circumference of the central receiver;

the ring adapted to receive a heating material;

the ring further comprising a plurality of ring apertures disposed therethrough;

the bowl further comprising a collar disposed upwardly from an outer perimeter of the bowl.

8. The hookah bowl of claim 7, wherein the collar is comprised of a heat reflective material.

9. The hookah bowl of claim 8, wherein the heat reflective material is porcelain.

10. The hookah bowl of claim 7, wherein the collar is flexible.

11. The hookah bowl of claim 7, wherein the lower stem is cylindrical.

12. The hookah bowl of claim 7, wherein the central receiver is cylindrical.

13. The hookah bowl of claim 7, wherein the central receiver has an open upper end.

14. The hookah bowl of claim 7, wherein the central receiver comprises a plurality of receiver apertures disposed through a bottom two-thirds thereof.

15. A hookah bowl, comprising:

a bowl including a lower stem disposed on a bottom surface of the bowl;

the lower stem secures the bowl to an upper end of a reservoir of a hookah pipe;

the bowl further comprising a central receiver disposed upwardly from a center portion of the bowl;

the central receiver in fluid communication with the reservoir;

the central receiver adapted to receive a smoking material;

the bowl further comprising a ring disposed around a circumference of the central receiver;

the ring adapted to receive a heating material;

the bowl further comprising a flexible collar disposed upwardly from an outer perimeter of the bowl.

* * * * *